US005385455A

United States Patent [19]

Dinsmore et al.

[11] Patent Number: 5,385,455

[45] Date of Patent: Jan. 31, 1995

[54] FLOW CONTROL VALVE

[75] Inventors: Larry E. Dinsmore, Frankenmuth; Gary G. Hegler, Chesaning, both of Mich.

[73] Assignee: General Motors Corporation, Detroit, Mich.

[21] Appl. No.: 107,881

[22] Filed: Aug. 18, 1993

[51] Int. Cl.[6] ..... F04B 7/00

[52] U.S. Cl. ..... 417/505; 137/117; 251/129.08

[58] Field of Search ..... 417/505; 251/129.21, 251/129.08; 137/117

[56] References Cited

U.S. PATENT DOCUMENTS

| | | | |
|---|---|---|---|
| 1,622,672 | 3/1927 | Raymond | 251/129.21 |
| 3,183,932 | 5/1965 | Karpars, Jr. | 251/129.21 |
| 4,121,610 | 10/1978 | Harms et al. | 137/117 |
| 4,251,193 | 2/1981 | Minnis et al. | 417/300 |
| 4,569,641 | 2/1986 | Falk et al. | 417/505 |
| 4,616,728 | 10/1986 | Suzuki et al. | 180/142 |
| 4,629,025 | 12/1986 | Brasier et al. | 180/142 |
| 4,662,567 | 5/1987 | Knapp | 251/129.21 |
| 4,691,619 | 9/1987 | Kervagoret | 137/501 |
| 4,962,871 | 10/1990 | Reeves | 251/129.21 |
| 5,083,747 | 1/1992 | Schmitt-Matzen | 251/129.21 |

FOREIGN PATENT DOCUMENTS

| | | | |
|---|---|---|---|
| 0514982 | 5/1976 | U.S.S.R. | 251/129.21 |

*Primary Examiner*—Richard A. Bertsch
*Assistant Examiner*—M. Kocharov
*Attorney, Agent, or Firm*—Saul Schwartz

[57] ABSTRACT

An electronic variable orifice flow control valve includes a valve body mounted on a hydraulic pump housing in a valve bore of the housing, a valve seat on the valve body, a metering rod cooperating with the vale seat in defining a variable orifice, and a solenoid having an armature connected to the metering rod and mounted on a body of the solenoid for bodily shiftable movement between retracted and extended positions. The solenoid body has a concentric discharge type discharge port therein, i.e. a discharge port through which fluid flows concentric with a longitudinal centerline of the valve bore, and the solenoid armature is tubular so that a fluid flow path is defined from the variable orifice to the concentric discharge type discharge port through the armature.

2 Claims, 2 Drawing Sheets

FLOW CONTROL VALVE

FIELD OF THE INVENTION

This invention relates to electronic variable orifice flow control valves for hydraulic pumps.

BACKGROUND OF THE INVENTION

U.S. Pat. No. 4,251,193, issued Feb. 17, 1981 and assigned to the assignee of this invention, describes a mechanical variable orifice flow control valve for a hydraulic pump including a spool slidable in a valve bore in a housing of the pump and a valve body defining a "concentric discharge" type discharge port of the valve through which fluid flows concentrically relative to a longitudinal centerline of the valve bore. U.S. Pat. No. 4,629,025, issued Dec. 16, 1986 and assigned to the assignee of this invention, describes an electronic variable orifice flow control valve including a spool slidable in a valve bore, a tubular valve body in the valve bore, and a solenoid mounted on and closing an outboard end of the tubular valve body. The solenoid controls the position of a metering rod which cooperates with a stationary valve seat on the valve body in defining a variable orifice. A "lateral discharge" type discharge port of the valve, i.e. a discharge port through which the direction of fluid flow is perpendicular to a longitudinal centerline of the valve bore, is defined in a sleeve mounted on the valve body outside of the pump housing. An electronic variable orifice flow control valve according to this invention retains the performance advantages of electronic control of the variable orifice and has manufacturing and installation advantages associated with a concentric discharge type discharge port and is, therefore, an improvement relative to electronic variable orifice flow control valves having lateral discharge type discharge ports.

SUMMARY OF THE INVENTION

This invention is a new and improved electronic variable orifice flow control valve for a hydraulic pump including a spool slidable in a valve bore in a housing of the pump, a tubular valve body mounted on the pump housing in the valve bore, and a solenoid. The solenoid includes a tubular body mounted on the valve body, a coil around the solenoid body, and a tubular armature mounted in the solenoid body for back and forth bodily shiftable movement in the direction of the longitudinal centerline of the valve bore. A metering rod is attached to the tubular armature through a plurality of radial struts and cooperates with a stationary valve seat on the valve body in defining an orifice having a flow area varying in accordance with the position of the tubular armature. An outboard end of the tubular solenoid body defines a concentric discharge type discharge port of the valve in flow communication with the variable orifice through the solenoid body, the tubular armature, and the interstices between the radial struts.

DESCRIPTION OF A PRIOR ART ELECTRONIC VARIABLE ORIFICE FLOW CONTROL VALVE

Figure 1:
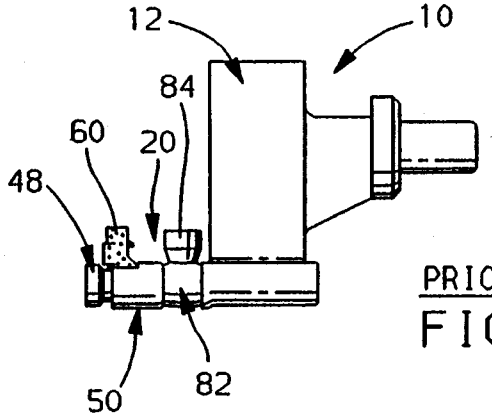
PRIOR ART FIG. 1
FIG. 1 is an elevational view of a hydraulic pump having mounted thereon a prior art electronic variable orifice flow control valve.
Figure 2:
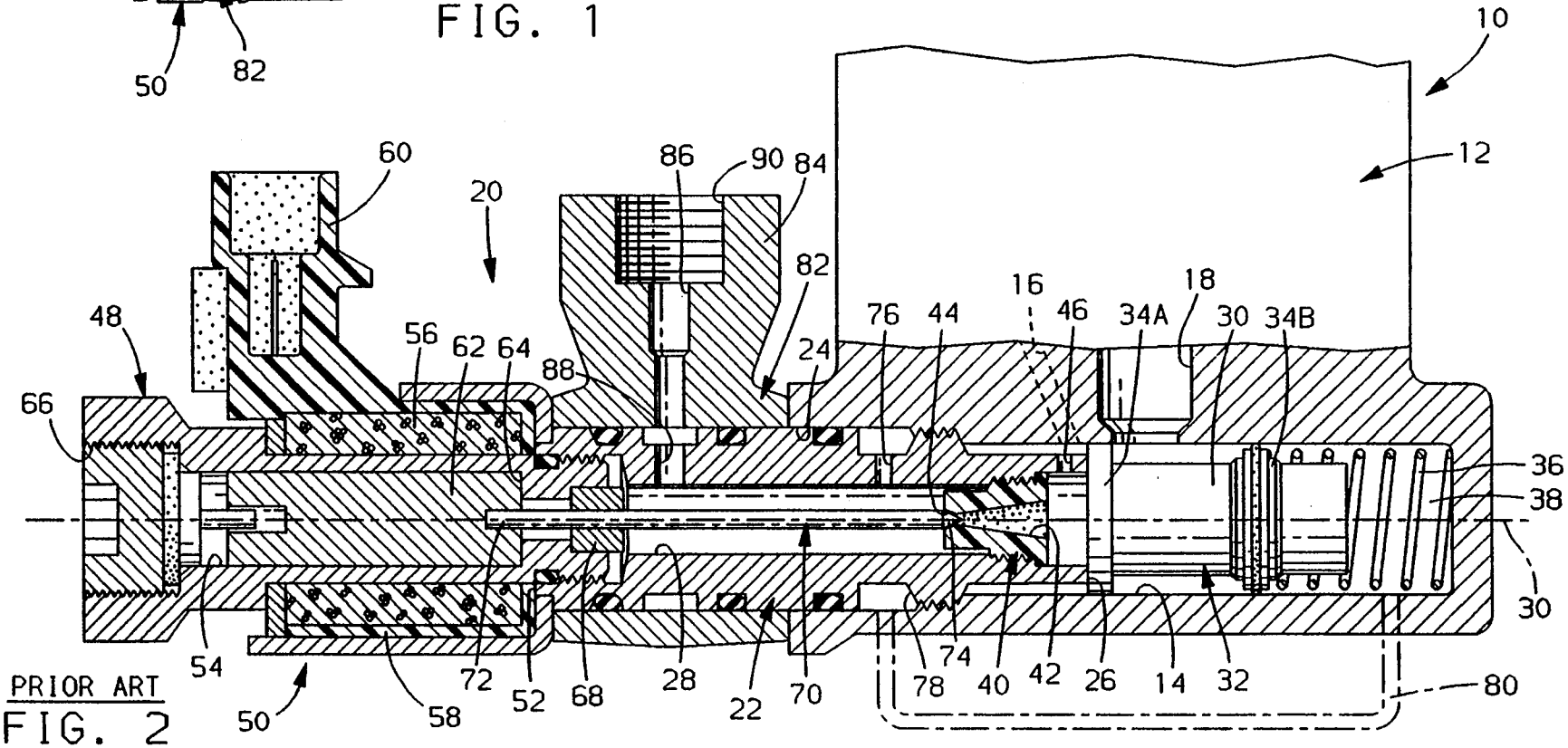
PRIOR ART FIG. 2
FIG. 2 is a longitudinal sectional view of a portion of FIG. 1.

Referring to FIGS. 1 and 2, a hydraulic pump 10 suitable for use in a motor vehicle power steering system, not shown, includes a housing 12 having a valve bore 14 therein. When the pump is in operation, a rotating group thereof, not shown, induces fluid flow in a high pressure passage 16 in the pump housing 12 which intersects the valve bore 14. A low pressure passage 18 in the pump housing also intersects the valve bore 14 and is connected to a fluid inlet, not shown, to the rotating group. An electronic variable orifice ("EVO") valve 20 is disposed in the valve bore 14. Except for the EVO valve 20, the pump 10 may be constructed as described in U.S. Pat. Nos. 3,207,077 and 3,253,548, issued Sep. 21, 1965 and May 31, 1966, respectively, and assigned to the assignee of this invention.

A valve body 22 of the EVO valve 20 is retained by screw threads in an outboard end 24 of the valve bore 14 with a first end 26 of the valve body located between the high pressure passage 16 and the low pressure passage 18 and with a center passage 28 of the valve body concentric with a longitudinal centerline 30 of the valve bore. A spool 32 is disposed in the valve bore 14 for bodily shiftable movement in the direction of a longitudinal centerline 30 of the valve bore and includes a pair of annular lands 34A–B in fluid sealed, sliding engagement on the wall of the valve bore. A spring 36 in a chamber 38 between the spool and the closed end of the valve bore biases the spool toward engagement on the first end 26 of the valve body 22, FIG. 2, in which position the land 34A separates the high pressure passage 16 from the low pressure passage 1*b*.

A plastic insert 40, having a bore 42 therethrough, is attached by screw threads to the valve body in the center passage 28. A flared end of the bore 42 in the insert 40 defines a frustoconical valve seat 44 of the EVO valve 20. An aperture 46 in the valve body 22 maintains fluid communication between the high pressure passage 16 and the center passage 28 of the valve body upstream of the valve seat 44 when the spool 32 abuts the first end 26 of the valve body, FIG. 2.

A body 48 of an electric solenoid 50 of the EVO valve is attached by screw threads to the valve body 22 at a second end 52 thereof. The solenoid body 48 has a bore 54 therein concentric with the valve bore 14. A wire coil 56 of the solenoid is disposed around the bore 54 within a plastic shield 58 which also defines a connector 60 for attaching a wiring harness to the coil 56. A solid cylindrical armature 62 of the solenoid is disposed in the bore 54 for bodily shiftable movement in the direction of the longitudinal centerline 30 between an extended position, FIG. 2, bearing against a shoulder 64 of the solenoid body and a retracted position, not shown, bearing against a plug 66 attached by screw threads to the solenoid body and closing the open end of bore 54 therein.

A brass bushing 68 blocks the center passage 28 in the valve body and supports a metering rod 70 for bodily shiftable movement in the direction of the longitudinal centerline 30. The metering rod 70 is aligned on the centerline 30 and has a first end 72 rigidly connected to the solenoid armature 62 and a tapered second end 74 cooperating with the valve seat 44 in defining a variable orifice of the EVO valve 20. An aperture 76 in the valve body, a groove 78 in the valve body, and a schematically represented passage 80 in the pump housing 12 effect fluid communication between the center passage 28 downstream of the variable orifice and the chamber 38 behind the spool 32.

A sleeve 82 is fitted in fluid sealed fashion around the valve body 22 between the pump housing 12 and the coil 56 of the solenoid 50. A boss 84 on the sleeve 82 has a radial passage 86 therein aligned with a similar radial passage 88 in the valve body 22 which intersects the center passage 28 between the brass bushing 68 and the variable orifice. A screw threaded counterbore 90 in the boss 84 at the end of the radial passage 86 affords an attachment for a union, not shown, defining a connection between a fluid conduit, not shown, and the boss 84. Fluid flowing from the high pressure passage 16 in the pump housing through the variable orifice of the EVO valve 20 is conducted by the center passage 28 and the radial passages 88,86 to the threaded counterbore 90 which, accordingly, defines a lateral discharge type discharge port of the EVO valve 20.

DESCRIPTION OF A PREFERRED EMBODIMENT

Figure 3:
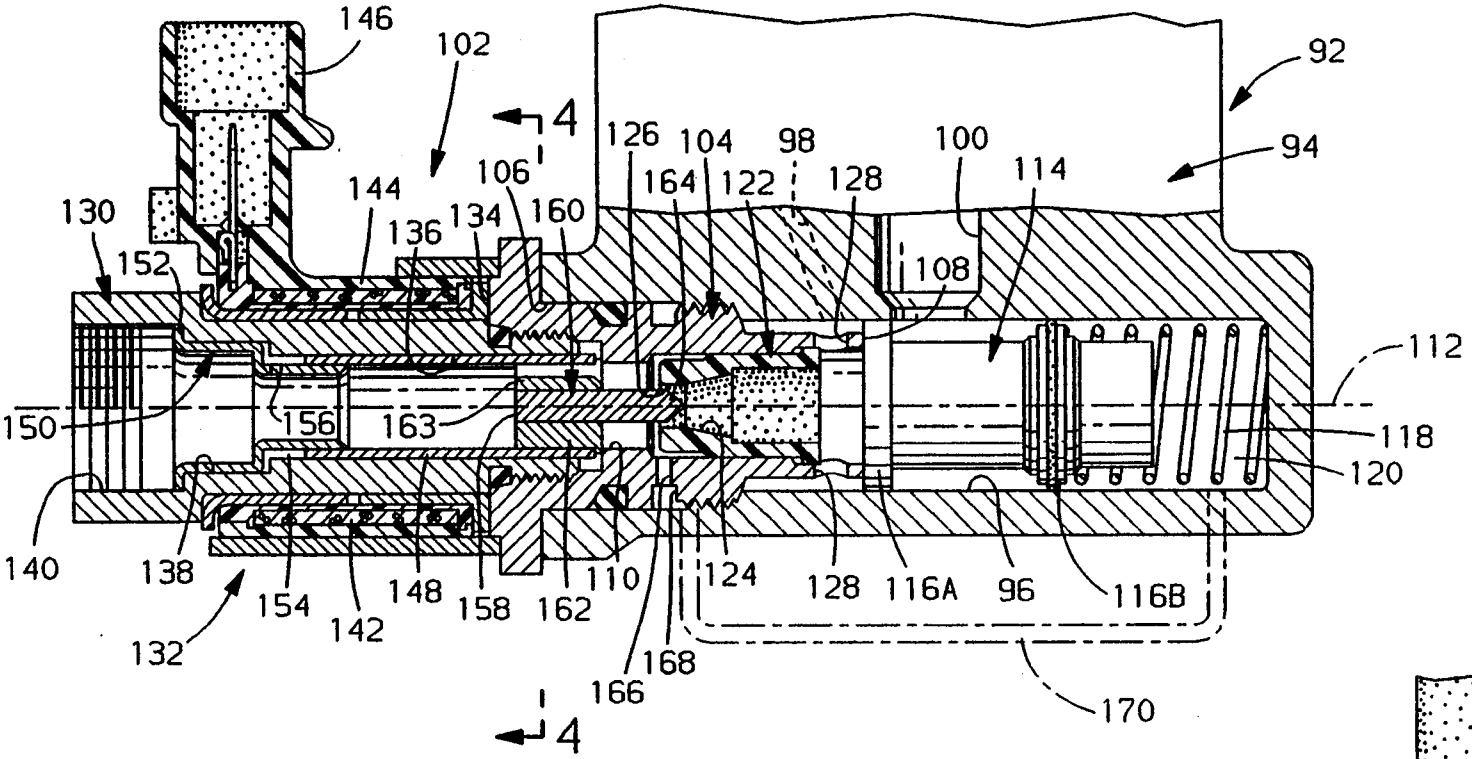
FIG. 3 is similar to FIG. 2 but showing an electronic variable orifice flow control valve according to this invention.
Figure 4:
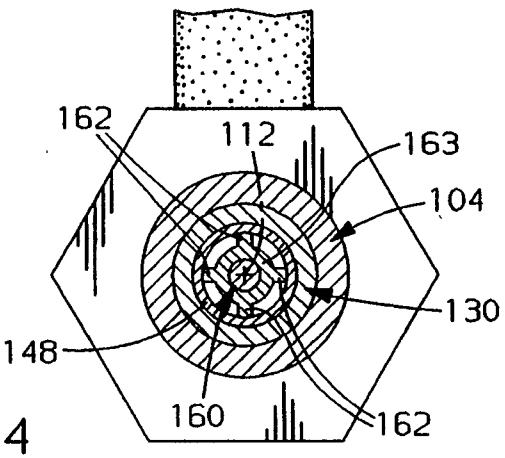
FIG. 4 is a sectional view taken generally along the plane indicated by lines 4—4 in FIG. 3.

Referring to FIGS. 3–4, a hydraulic pump 92 suitable for use in a motor vehicle power steering system, not shown, includes a housing 94 having a valve bore 96 therein. When the pump is in operation, a rotating group thereof, not shown, induces fluid flow in a high pressure passage 98 in the pump housing 94 which intersects the valve bore 96. A low pressure passage 100 in the pump housing also intersects the valve bore 96 and is connected to a fluid inlet, not shown, to the rotating group. An electronic variable orifice ("EVO") valve 102 according to this invention is disposed in the valve bore 96. Except for the EVO valve 102, the pump 92 may be constructed as described in the aforesaid U.S. Pat. Nos. 3,207,077 and 3,253,548.

A tubular valve body 104 of the EVO valve 102 is retained by screw threads in an outboard end 106 of the valve bore 96 with a first end 108 of the valve body located between the high pressure passage 98 and the low pressure passage 100 and with a center passage 110 of the valve body concentric with a longitudinal centerline 112 of the valve bore. A spool 114 is disposed in the valve bore 96 for bodily shiftable movement in the direction of a longitudinal centerline 112 of the valve bore and includes a pair of annular lands 116A–B in fluid sealed sliding engagement on the wall of the valve bore. A spring 118 in a chamber 120 between the spool and the closed end of the valve bore biases the spool toward engagement on the first end 108 of the valve body 104, FIG. 3, in which position the land 116A separates the high pressure passage 98 from the low pressure passage 100.

A plastic insert 122, having a bore 124 therethrough, is attached by screw threads to the valve body in the center passage 110. An end of the bore 124 defines a circular valve seat 126 of the EVO valve 102 concentric with and in a plane perpendicular to the centerline 112 of the valve bore. A plurality of apertures 128 in the valve body 104 maintain fluid communication between the high pressure passage 98 and the center passage 110 of the valve body upstream of the valve seat 126 when the spool 114 abuts the first end 108 of the valve body, FIG. 3.

A body 130 of an electric solenoid 132 of the EVO valve 102 is attached by screw threads to the valve body 104 at a second end 134 thereof. The solenoid body 130 has a stepped bore therein symmetric about the centerline 112 including a small diameter cylindrical portion 136, an intermediate diameter cylindrical portion 138, and a large diameter screw threaded portion 140. A wire coil 142 of the solenoid is disposed generally around the small diameter portion 136 of the stepped bore within a plastic shield 144 which also defines a connector 146 for attaching a wiring harness to the coil 142. A tubular armature 148 of the solenoid is disposed in the small diameter portion 136 of the stepped bore for bodily shiftable movement in the direction of the longitudinal centerline 112.

A hollow, thimble-like damper tube 150 having a shape corresponding generally to the stepped bore in the solenoid body 130 is pressed into the stepped bore until a lip 152 on the damper tube seats against a shoulder of the stepped bore between the large and intermediated diameter portions 140,138 thereof. The tubular armature 148 of the solenoid is slidably piloted on a cylindrical inboard end of the damper tube 150 and an annular damping chamber 154 is defined between the tubular armature and the damper tube. An aperture 156 in the damper tube communicates with the damping chamber 154.

As seen best in FIG. 4, a first end 158 of a cylindrical metering rod 160 is rigidly connected to the tubular armature 148 through a plurality of radial struts 162, each integral with a hub 163 rigidly attached to the metering rod and each also rigidly attached to an inner surface of the tubular armature 148. A tapered second end 164 of the metering rod 160 cooperates the valve seat 126 in defining therebetween a variable orifice of the EVO valve 102. An aperture 166 in the valve body, a groove 168 in the valve body, and a schematically represented passage 170 in the pump housing 94 effect fluid communication between the center passage 110 downstream of the variable orifice and the chamber 120 behind the spool 114.

When the rotating group of the pump 92 is stationary, the spring 118 seats the spool 114 against the first end 108 of the valve body 104, FIG. 3. When the rotating group is set in motion, fluid in the high pressure passage 98 in the pump housing flows through the apertures 128 in the valve body, the bore 124 in the insert 122, and the valve seat 126.

If the solenoid 132 is off, i.e. no current flowing through the coil 142, the metering rod 160 and the tubular armature 148 are shifted by fluid pressure to a retracted position of the armature, not shown, defined by engagement of the armature against the damper tube 150. Fluid in the damping chamber 154 is expelled through the aperture 156 in the damper tube. In the retracted position of the armature, the variable orifice between the valve seat 126 and the tapered end 164 of the metering rod has maximum flow area and fluid flows through the variable orifice, in the interstices between the struts 162 attaching the hub 163 on the metering rod to the armature, and then through the tubular armature 148 and the damper tube 150 to a concentric discharge type discharge port of the EVO valve 102 defined at the screw threaded large diameter portion 140 of the stepped bore.

As long as the solenoid is off, the fluid pressure upstream of the variable orifice is insufficient to overcome the force of spring 118 so that the all of the fluid in the high pressure passage 98 is directed out through the concentric discharge port of the EVO valve 102. When the solenoid is turned on, magnetic flux induced by current in the coil 142 bodily shifts the tubular armature 148 and the metering rod 160 toward the insert 122.

The tapered end 164 of the metering rod penetrates the valve seat 126 and cooperates therewith in reducing the flow area of the variable orifice defined therebetween. In an extended position of the armature 148 defined by engagement of the armature against a shoulder on the valve body, FIG. 3, the flow area of the variable orifice is minimum. During movement of the armature 148 to its extended position, fluid reenters the damping chamber 154 through the aperture 156.

In the extended position of the armature, the fluid pressure upstream of the variable orifice is elevated relative to the fluid pressure at the same location in the retracted position of the armature and is of sufficient magnitude to shift the spool 114 to the right, FIG. 3. In that circumstance, the land 116A on the spool uncovers a portion of the low pressure passage 100 in the pump housing so that a fraction of the fluid in the high pressure passage 98 bypasses the flow path defined through the EVO valve 102 and flows directly into the low pressure passage 100.

The magnitude of the fraction of pump flow bypassed directly to the low pressure passage 100 is determined by the duty cycle of the solenoid 132. For example, when the coil 142 is continuously energized and the armature 148 continuously maintained in its extended position, bypass is maximum and flow through the concentric discharge port of the EVO valve 102 is minimum. If the coil is energized cyclically, the flow area of the variable orifice and the fraction of pump flow bypassed directly to the low pressure passage are intermediate their maximum and minimum magnitudes. As the armature 148 moves between its extended and retracted positions, fluid flowing in and out of the damping chamber 154 through the aperture 156 damps the excursions of the armature.

The embodiments of the invention in which an exclusive property or privilege is claimed are defined as follows:

1. In combination with a hydraulic pump including a housing with a valve bore therein having a longitudinal centerline, an EVO valve comprising:

a valve body having a center passage therein, means mounting said valve body on said pump housing, means on said valve body defining a valve seat in said center passage symmetric about said longitudinal centerline of said valve bore, a solenoid body rigidly attached to said valve body having a bore therein concentric with said longitudinal centerline of said valve bore and cooperating with said valve bore in defining a fluid flow path of said EVO valve, means defining a concentric discharge type discharge port of said EVO valve on said valve body concentric with said longitudinal centerline of said valve bore and in fluid communication with said fluid flow path, a wire coil on said solenoid body around said bore in said solenoid body, a tubular solenoid armature mounted in said bore in said solenoid body for bodily shiftable movement in the direction of said longitudinal centerline of said valve bore between a retracted position and an extended position when said wire coil carries an electric current, a damper tube mounted on said solenoid bode and cooperating with said bore is said solenoid body in defining an annular damping chamber exposed to an end of said tubular solenoid, means defining an orifice in said damper tube in fluid communication with said fluid flow path for admitting fluid to said damping chamber and for exhausting fluid from said damping chamber, a metering rod, and means rigidly connecting said metering rod to said tubular solenoid armature for bodily shiftable movement as a unit therewith so that said metering rod cooperates with said valve seat in defining a variable orifice of said EVO valve having a maximum size in said retracted position of said armature and a minimum size in said extended position of said armature and operative to permit fluid flow through said tubular armature around said metering rod.

2. The EVO valve recited in claim 1 wherein said means rigidly connecting said metering rod to said solenoid armature for bodily shiftable movement as a unit therewith includes:

a hub means rigidly attached to said metering rod including a plurality of radial struts connected to said tubular armature having interstices therebetween for fluid flow between said radial struts.

* * * * *